US007727032B2

(12) United States Patent
Szu

(10) Patent No.: US 7,727,032 B2
(45) Date of Patent: Jun. 1, 2010

(54) ELECTRICAL CONTACT WITH STOPPER AND ELECTRICAL CONNECTOR HAVING THE SAME

(75) Inventor: Ming-Lun Szu, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/574,788

(22) Filed: Oct. 7, 2009

(65) Prior Publication Data

US 2010/0087102 A1 Apr. 8, 2010

(30) Foreign Application Priority Data

Oct. 7, 2008 (TW) ..... 97217904 U

(51) Int. Cl.
*H01R 11/22* (2006.01)

(52) U.S. Cl. ..... 439/857; 439/342

(58) Field of Classification Search ..... 439/342, 439/856–858
See application file for complete search history.

(56) References Cited

U.S. PATENT DOCUMENTS 6,450,826 B1 * 9/2002 Howell et al. ..... 439/342
6,554,634 B1 4/2003 Lin et al.
7,303,421 B2 * 12/2007 Liao ..... 439/342

* cited by examiner

*Primary Examiner*—Tho D Ta
(74) *Attorney, Agent, or Firm*—Andrew C. Cheng; Wei Te Chung; Ming Chieh Chang

(57) ABSTRACT

An electrical contact (1) includes an elongate planar base portion (10), a pair of contact engaging portions (11) orthogonal to the planar base portion, a stopper portion (12) coplanar with the contact engaging portions, and a solder portion (13) orthogonal to the planar base portion and opposite to the contact engaging portions. The stopper portion connects one of the pair of contact engaging portions and extends to a back side of the planar base portion.

6 Claims, 4 Drawing Sheets

ELECTRICAL CONTACT WITH STOPPER AND ELECTRICAL CONNECTOR HAVING THE SAME

CROSS-REFERENCE TO RELATED APPLICATIONS

This patent application relates to an earlier filed co-pending U.S. patent application Ser. No. 12/549,399 filed on Aug. 28, 2009, entitled "ELECTRICAL CONTACT WITH MULTIPLE CONTACTING POINTS" (US22389), which has the same applicant and assignee as the present invention.

BACKGROUND OF THE INVENTION

1. Field of the Invention

The present invention relates generally to an electrical contact, and more particularly to a ZIF (zero insertion force) contact having a stopper portion preventing over-slippage of a pin leg of a CPU.

2. Description of Related Arts

U.S. Pat. No. 6,554,634 issued to Lin et al. on Apr. 29, 2003 discloses an electrical contact connecting a pin leg of a CPU (central processing unit) package onto a PCB (printed circuit board). The electrical contact has a base portion, a solder portion extending from the base portion, and a pair of spaced arms. Each arm has a body section extending from the base portion and a finger including a lead-in section extending from the body section and a contact section extending from the lead-in section. The lead-in sections of the fingers are coined to define planar lead-in surfaces for guiding the pin leg of the CPU into the contact sections with zero insertion force. However, the contact sections define an opening slot to the air, and the pin leg of the CPU easily over slips beyond the contact section because there is no obstacle for the pin leg. The electrical connection between the CPU and the PCB is destroyed.

Hence, an electrical contact having a stopper portion preventing over-slippage of a pin leg of a CPU is desired.

SUMMARY OF THE INVENTION

Accordingly, an object of the present invention is to provide an electrical contact having a stopper portion preventing over-slippage of a pin leg of a CPU.

To achieve the above object, an electrical contact includes an elongate planar base portion, a pair of contact engaging portions orthogonal to the planar base portion, a stopper portion coplanar with the contact engaging portions, and a solder portion orthogonal to the planar base portion and opposite to the contact engaging portions. The stopper portion connects one of the pair of contact engaging portions and extends to a back side of the planar base portion.

Other objects, advantages and novel features of the invention will become more apparent from the following detailed description when taken in conjunction with the accompanying drawings.

DETAILED DESCRIPTION OF THE PREFERRED EMBODIMENT

Figure 1:
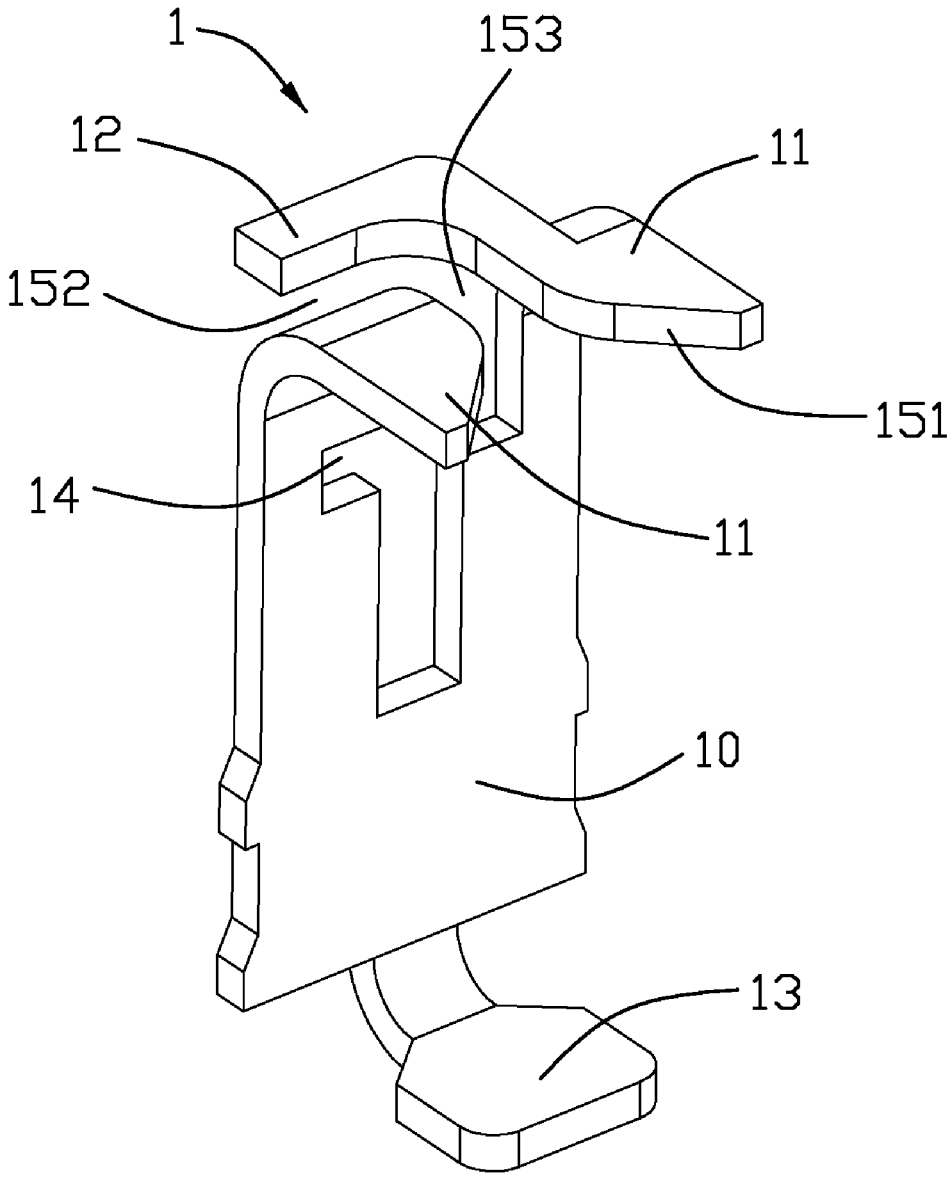
FIG. 1 is a perspective view of an electrical contact constructed in accordance with the present invention.
Figure 2:
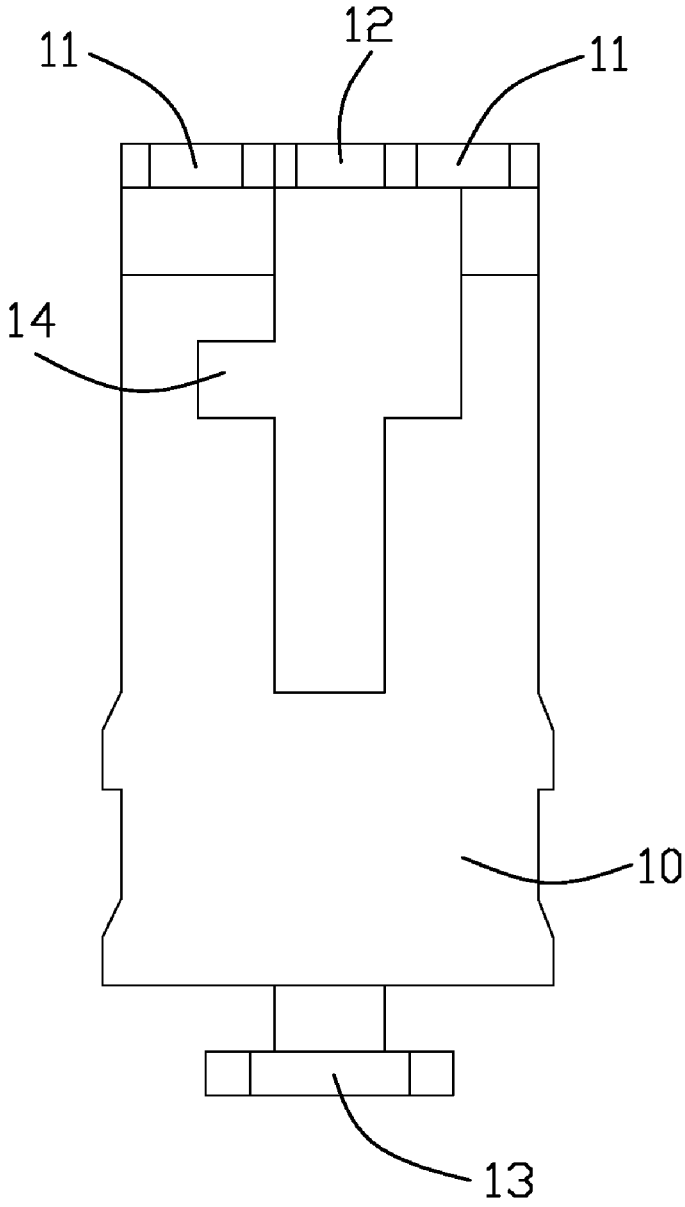
FIG. 2 is a front elevational view of the electrical contact of FIG. 1.
Figure 3:
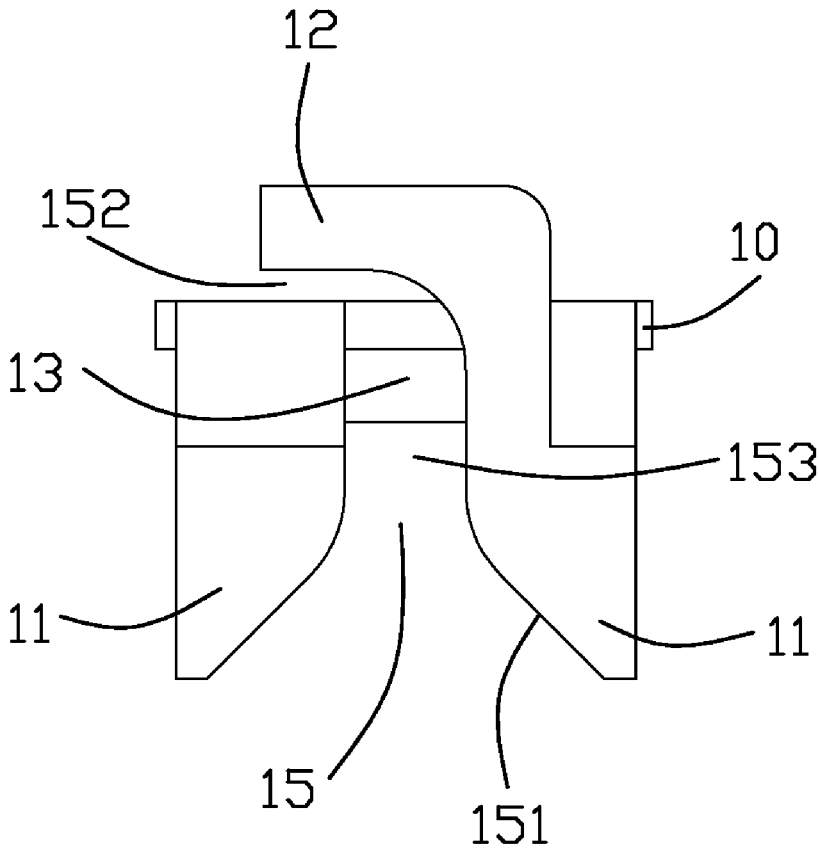
FIG. 3 is a top plan view of the electrical contact of FIG. 1.
Figure 4:
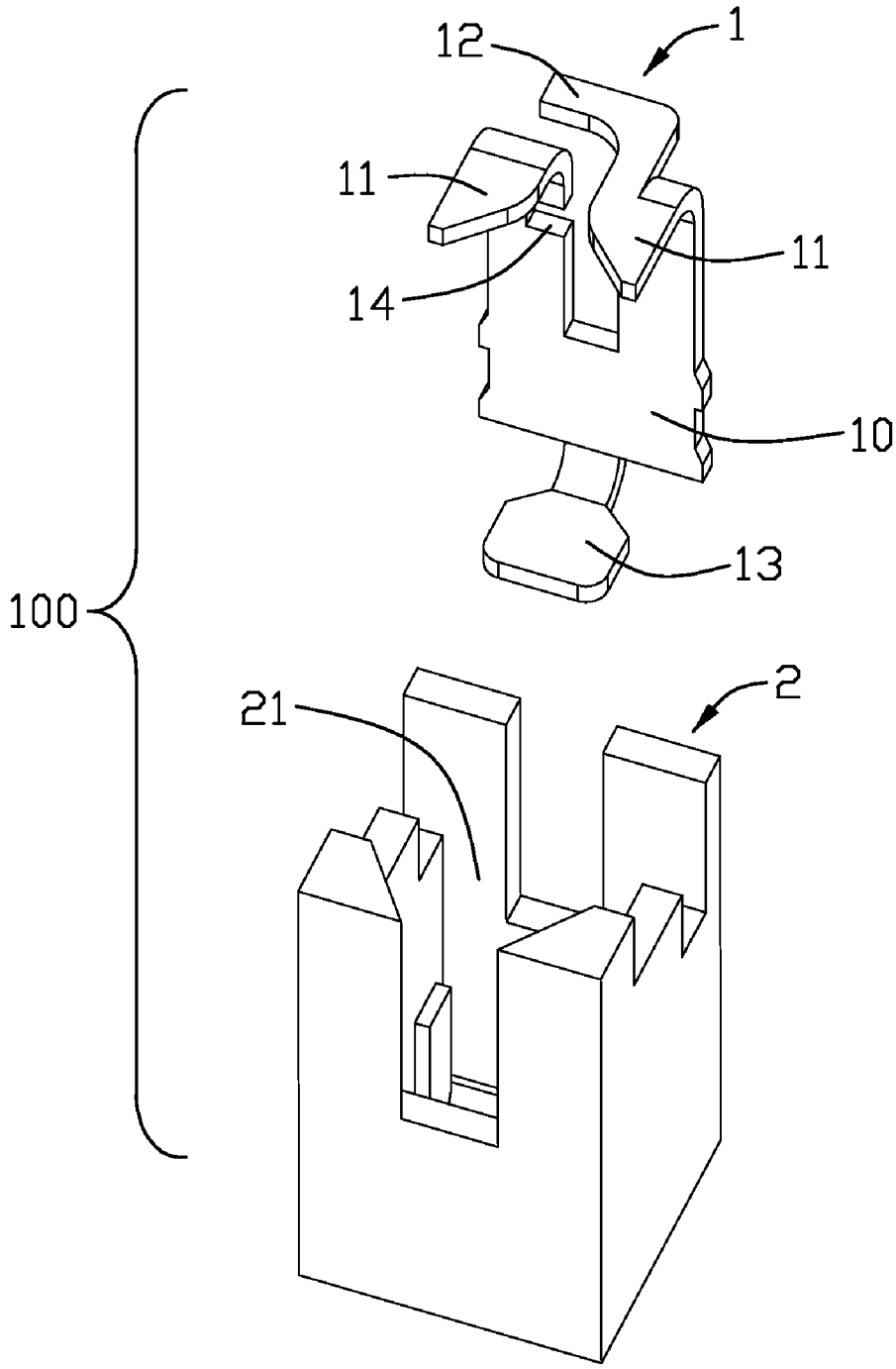
FIG. 4 is an exploded view of an electrical connector constructed in accordance with the present invention.

Referring to FIGS. 1-4, an electrical connector 100 of the present invention, used for connecting a CPU (central processing unit, not shown) with a PCB (printed circuit board), comprises an insulative housing 2 defining a passageway 21 and an electrical contact 1 received in the passageway 21 of the insulative housing 2. The electrical contact 1 comprises an elongate planar base portion 10, a pair of contact engaging portions 11 orthogonal to the planar base portion 10, a stopper portion 12 integral with the one of the contact engaging portions 11, coplanar with the contact engaging portions 11 and substantially parallel with the planar base portion 10, and a solder portion 13 orthogonal to the planar base portion 10 and opposite to the contact engaging portions 11. The stopper portion 12 is stamped from the planar base portion 10 to leave a cutout 14. In a top view of the electrical contact 1 as FIG. 3, the stopper portion 12 projects from one of the pair contact engaging portions 11 and extends to a back side of the planar base portion 10. The contact engaging portions 11 and the stopper portion 12 define a slot 15. The cutout 14 communicates with the slot 15. The slot 15 comprises an access 151 between the contact engaging portion 11, and an exit 152 beside the stopper portion 12 and a transition 153 therebetween. The slot 15 spans the planar base portion 10. The access 151 and the exit 152 are located at opposite sides of the planar base portion 10. The exit 152 has a dimension smaller than transition 153 and the transition 153 has a dimension smaller than the access 151.

When a pin leg of the CPU is inserted into the access 151 with zero insertion force and then, is guided into the transition 153. The pin leg mechanically and electrically connects with the contact engaging portions 11 in general condition. If the pin leg is over-inserted, the stopper portion 12 prevents the pin leg from disengaging away from the contact engaging portions 11. The pin leg achieves multiple engagements with the contact engaging portions 11 and the stopper portion 12. The stopper portion 12 is alternatively regarded as a part of the contact engaging portion 11. Accordingly, the contact engaging portion 11 spanning opposite sides of the planar base portion 10 is regarded. Because the stopper portion 12 is stamped from the planar base portion 10, the prevent invention achieves a cost of material.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical contact for using in a CPU (central processing unit) socket, comprising:

an elongate planar base portion; a pair of contact engaging portions extending in a plane orthogonal to the elongate planar base portion;

a stopper portion being coplanar with the pair of contact engaging portions, connecting to one of the pair of contact engaging portions and extending to a back side of the elongate planar base portion; and a solder portion orthogonal to the elongate planar base portion and opposite to the pair of contact engaging portions.

2. The electrical contact as described in claim 1, wherein the pair of contact engaging portions and the stopper portion define a slot.

3. The electrical contact as described in claim 2, wherein the elongate planar base portion defines a cutout communicating with the slot.

4. The electrical contact as described in claim 2, wherein the stopper portion is stamped from the elongate planar base portion to leave a cutout.

5. The electrical contact as described in claim 2, wherein the slot has an access between the pair of contact engaging portions, an exit beside the stopper portion, and a transition therebetween.

6. The electrical contact as described in claim 5, wherein the exit has a dimension smaller than the access.

* * * * *